US010102963B2

(12) United States Patent
Shiokawa

(10) Patent No.: US 10,102,963 B2
(45) Date of Patent: Oct. 16, 2018

(54) COIL COMPONENT

(71) Applicant: MURATA MANUFACTURING CO., LTD., Kyoto-fu (JP)

(72) Inventor: Noboru Shiokawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 209 days.

(21) Appl. No.: 15/134,837

(22) Filed: Apr. 21, 2016

(65) Prior Publication Data

US 2016/0314895 A1 Oct. 27, 2016

(30) Foreign Application Priority Data

Apr. 27, 2015 (JP) ..... 2015-090723

(51) Int. Cl.

| | |
|---|---|
| ***H01F 27/02*** | (2006.01) |
| ***H01F 27/28*** | (2006.01) |
| ***H01F 17/06*** | (2006.01) |
| *H01F 17/00* | (2006.01) |

(52) U.S. Cl.

CPC ..... *H01F 27/2895* (2013.01); *H01F 17/062* (2013.01); *H01F 2017/0093* (2013.01); *H01F 2017/065* (2013.01)

(58) Field of Classification Search

USPC ..... 336/90, 229, 83, 192, 178

See application file for complete search history.

(56) References Cited

U.S. PATENT DOCUMENTS

| | | | | |
|---|---|---|---|---|
| 3,305,800 | A * | 2/1967 | Velsink | H01F 19/04 323/358 |
| 5,346,410 | A * | 9/1994 | Moore, Jr. | H01R 13/7197 333/12 |
| 7,889,047 | B2 | 2/2011 | Yang et al. | |
| 2004/0114298 | A1* | 6/2004 | Hsu | H03H 7/427 361/118 |
| 2005/0134290 | A1* | 6/2005 | Sarkozi | G01R 31/1272 324/543 |

(Continued)

FOREIGN PATENT DOCUMENTS

| | | | |
|---|---|---|---|
| CN | 201984923 | U | 9/2011 |
| JP | S53-030991 | U | 8/1978 |
| JP | S56-145122 | U1 | 11/1981 |

(Continued)

OTHER PUBLICATIONS

Notification of the Second Office Action issued by the State Intellectual Property Office of the People's Republic of China dated Dec. 18, 2017, which corresponds to Chinese Patent Application No. 201610264988.1 and is related to U.S. Appl. No. 15/134,837.

(Continued)

*Primary Examiner* — Elvin G Enad
*Assistant Examiner* — Kazi Hossain
(74) *Attorney, Agent, or Firm* — Studebaker & Brackett PC

(57) ABSTRACT

A coil component capable of increasing normal mode impedance while maintaining common mode impedance is provided. The coil component includes a toroidal core, a first coil conductor and a second coil conductor wound around the toroidal core, and a ferrite bead attached to at least one coil conductor of the first coil conductor and the second coil conductor.

7 Claims, 5 Drawing Sheets

(56) References Cited

U.S. PATENT DOCUMENTS

2008/0100400 A1* 5/2008 Lucas ..... H05K 9/0066
333/181

FOREIGN PATENT DOCUMENTS

| | | | |
|---|---|---|---|
| JP | H02-235418 | A | 9/1990 |
| JP | 11-097249 | A | 4/1999 |

OTHER PUBLICATIONS

The First Notification of Office Action issued by the State Intellectual Property Office of the People's Republic of China dated Jun. 2, 2017, which corresponds to Chinese Patent Application No. 201610264988.1 and is related to U.S. Appl. No. 15/134,837; with English language translation.

An Office Action; "Notice of Reasons for Rejection," issued by the Japanese Patent Office dated Oct. 17, 2017, which corresponds to Japanese Patent Application No. 2015-090723 and is related to U.S. Appl. No. 15/134,837.

An Office Action; "Notification of Reasons for Refusal," mailed by the Japanese Patent Office dated May 29, 2018, which corresponds to Japanese Patent Application No. 2015-090723 and is related to U.S. Appl. No. 15/134,837.

* cited by examiner

COIL COMPONENT

CROSS REFERENCE TO RELATED APPLICATIONS

This application claims benefit of priority to Japanese Patent Application 2015-090723 filed Apr. 27, 2015, the entire content of which is incorporated herein by reference.

TECHNICAL FIELD

The present disclosure relates to a coil component.

BACKGROUND

There is an existing coil component as disclosed in Japanese Unexamined Patent Application Publication No. 11-97249. The coil component includes a toroidal core and a first coil and a second coil wound around the toroidal core.

In the above-described existing coil component, when a normal mode current flows through the first coil and the second coil, a first magnetic flux by the first coil and a second magnetic flux by the second coil are generated in the toroidal core. The first magnetic flux and the second magnetic flux are in reverse directions, so that the first magnetic flux and the second magnetic flux cancel each other. Therefore, normal mode impedance cannot be increased. When the number of turns of the first coil or the second coil is increased, the normal mode impedance is increased but common mode impedance is also increased.

SUMMARY

Accordingly, it is an object of the present disclosure to provide a coil component capable of increasing normal mode impedance while maintaining common mode impedance.

According to a preferred embodiment of the present disclosure, to solve the aforementioned problem, there is provided a coil component including a toroidal core, a first coil conductor and a second coil conductor wound around the toroidal core, and a ferrite bead attached to at least one coil conductor of the first coil conductor and the second coil conductor.

With the coil component according to the preferred embodiment of the disclosure, the ferrite bead is attached to at least one coil conductor of the first coil conductor and the second coil conductor. Accordingly, normal mode impedance can be increased while maintaining common mode impedance.

Furthermore, in the coil component according to the preferred embodiment of the disclosure, one coil conductor is inserted into the ferrite bead.

What "the coil conductor which is inserted into the ferrite bead is one" means that "the coil conductor in the ferrite bead is one on a cross section in the direction orthogonal to an axis of the ferrite bead".

With the coil component according to the preferred embodiment of the disclosure, one coil conductor is inserted into the ferrite bead. Accordingly, the ferrite bead can be reduced in size and can be attached to a desired position. Furthermore, in the coil component according to the preferred embodiment of the disclosure, an axis of the ferrite bead is not concentric with but is eccentric from an axis of the toroidal core. Accordingly, an attachment position of the ferrite bead is not limited.

In the coil component according to the preferred embodiment of the disclosure, the ferrite bead is located at an end portion side of the coil conductor.

With the coil component according to the preferred embodiment of the disclosure, the ferrite bead is located at the end portion side of the coil conductor. Accordingly, the ferrite bead is easy to be attached to the coil conductor.

In the coil component according to the preferred embodiment of the disclosure, the ferrite bead is located on an outer side portion relative to the toroidal core in a radial direction.

With the coil component according to the preferred embodiment of the disclosure, the ferrite bead is located on the outer side portion relative to the toroidal core in the radial direction. Accordingly, the degree of freedom of arrangement of the ferrite bead relative to the toroidal core is enhanced.

In the coil component according to the preferred embodiment of the disclosure, a case accommodating the toroidal core is included, a shape of the case is substantially rectangular when seen from an axial direction of the toroidal core, and the ferrite bead is located on a corner portion of the case.

With the coil component according to the preferred embodiment of the disclosure, the ferrite bead is located on the corner portion of the case. Accordingly, the ferrite bead can be arranged in a dead space on the corner portion of the case, thereby utilizing the dead space effectively.

With the coil component according to the disclosure, the ferrite bead is attached to at least one of the first coil and the second coil. Accordingly, the normal mode impedance can be increased while maintaining the common mode impedance.

Other features, elements, characteristics and advantages of the present disclosure will become more apparent from the following detailed description of preferred embodiments of the present disclosure (with reference to the attached drawings).

DETAILED DESCRIPTION

Figure 1:
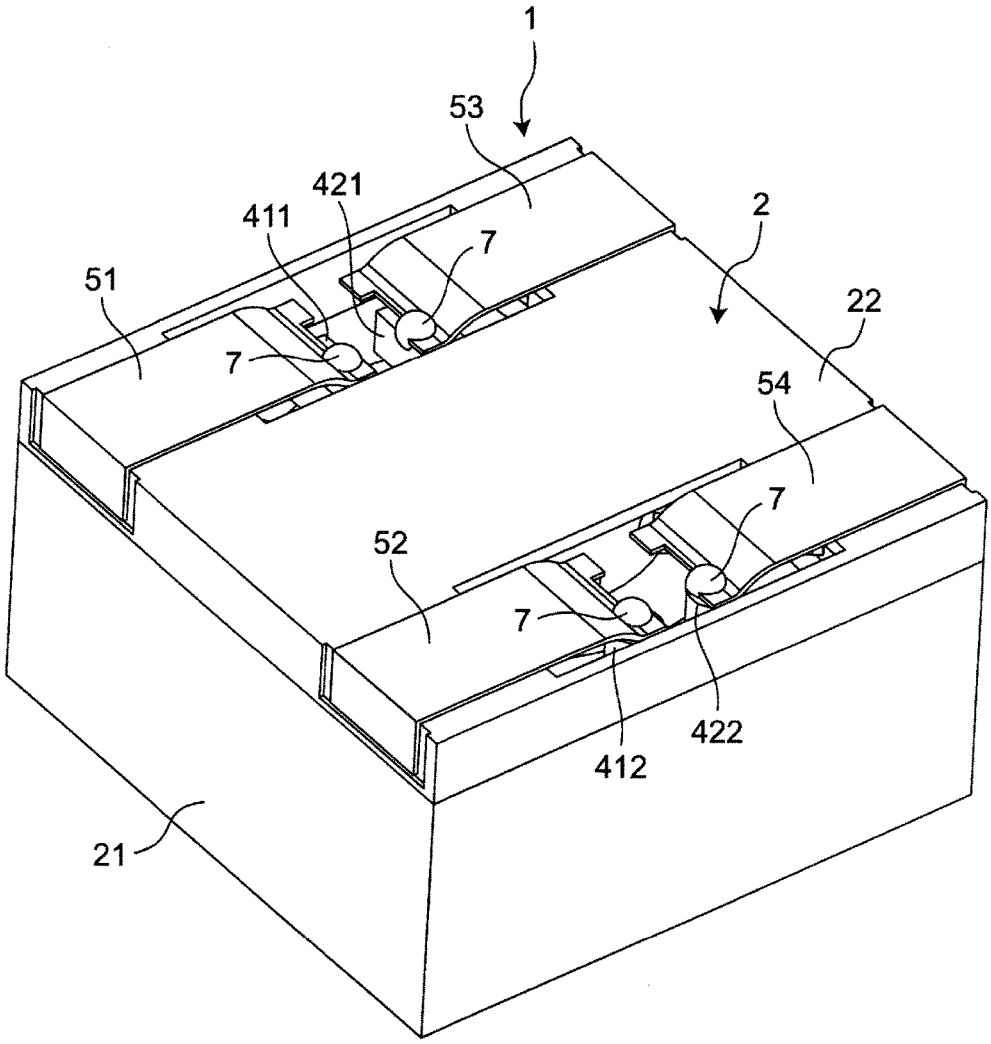
FIG. 1 is a perspective view illustrating a coil component according to one embodiment of the disclosure.

Hereinafter, the disclosure will be described more in detail with reference to an embodiment in the drawings.

Figure 2:
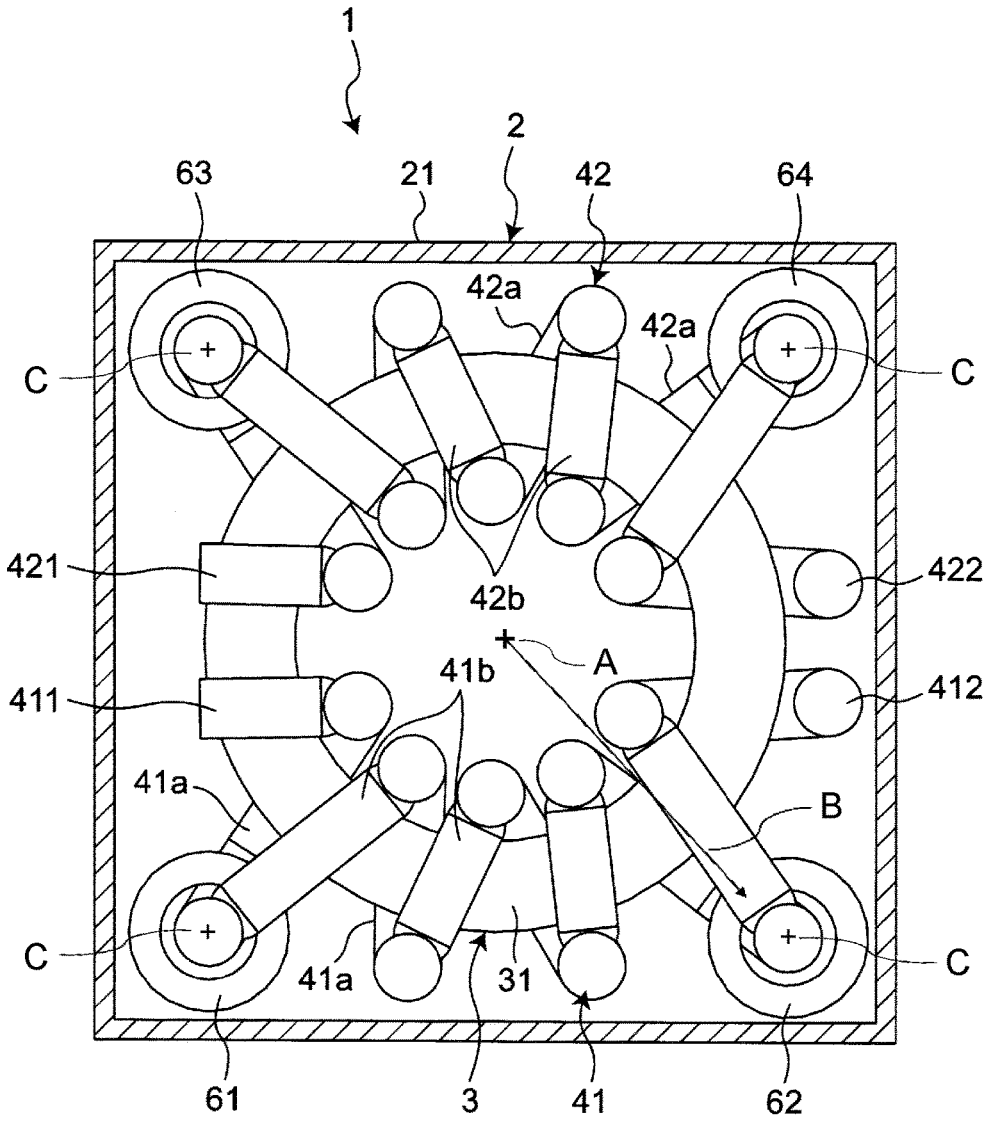
FIG. 2 is a plan view illustrating the coil component.
Figure 3:
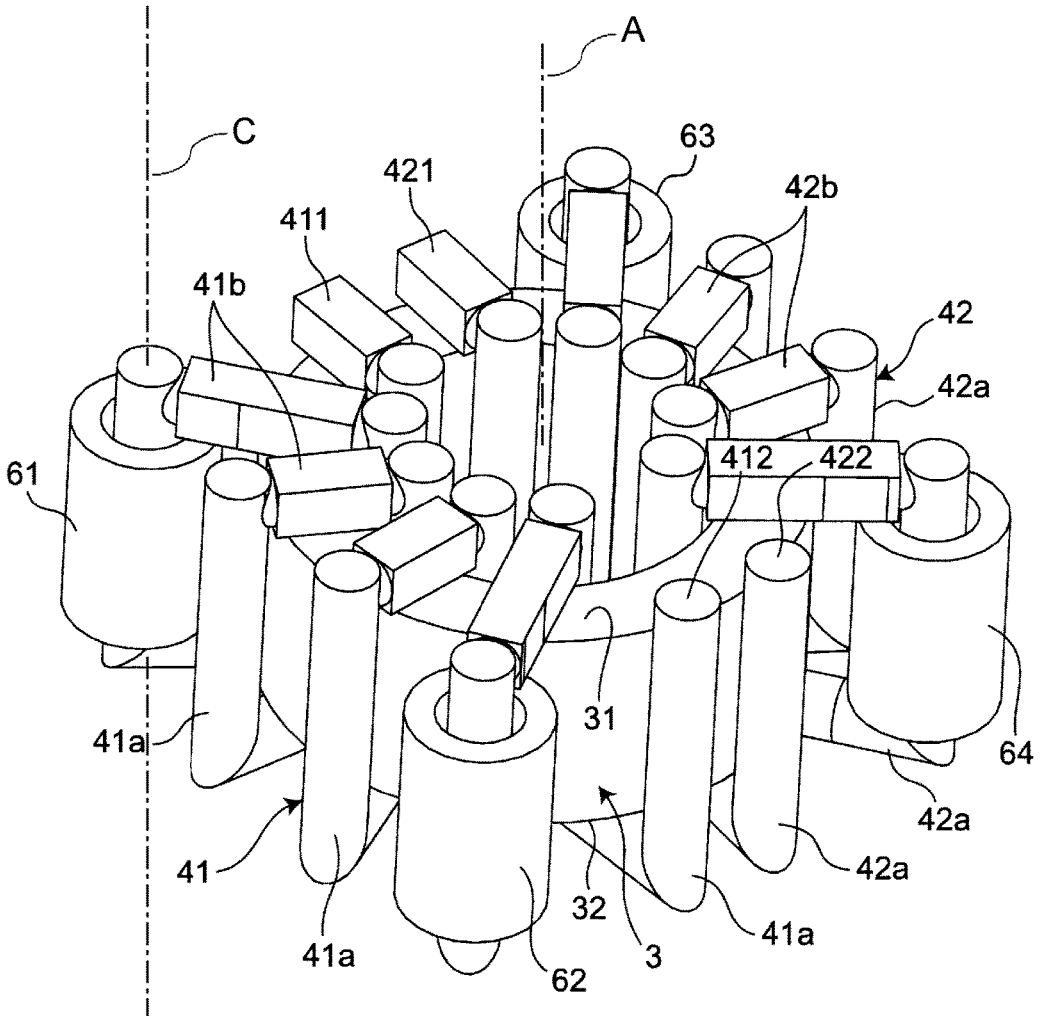
FIG. 3 is a perspective view illustrating a toroidal core and coil conductors.

FIG. 1 is a perspective view illustrating a coil component according to one embodiment of the disclosure. FIG. 2 is a plan view illustrating the coil component. FIG. 3 is a perspective view illustrating the coil component.

As illustrated in FIG. 1, FIG. 2, and FIG. 3, a coil component 1 includes a case 2, a toroidal core 3 accommodated in the case 2, a first coil conductor 41 and a second coil conductor 42 wound around the toroidal core 3, and ferrite beads 61 to 64 attached to the first coil conductor 41 and the second coil conductor 42. The coil component 1 is a common mode choke coil.

The case 2 is formed to have a substantially rectangular parallelepiped shape. The case 2 includes a box body 21 having an opening and a lid body 22 attached to the opening of the box body 21. The case 2 is formed with resin such as polyphenylene sulfide (PPS) or ceramics, for example. The box body 21 accommodates the toroidal core 3 therein. The shape of the box body 21 is substantially rectangular when seen from an axial direction (i.e., a direction of an axis A) of the toroidal core 3.

Electrode terminals 51 to 54 are attached to the lid body 22. The first electrode terminal 51 and the second electrode terminal 52 are adjacent to each other in one side direction of a substantially rectangular shape of the lid body 22 and the third electrode terminal 53 and the fourth electrode terminal 54 are adjacent to each other in one side direction of the substantially rectangular shape of the lid body 22. The first electrode terminal 51 and the third electrode terminal 53 oppose each other in the other side direction of the substantially rectangular shape of the lid body 22 and the second electrode terminal 52 and the fourth electrode terminal oppose each other in the other side direction of the substantially rectangular shape of the lid body 22.

The toroidal core 3 is formed to have a substantially cylindrical shape. For example, the toroidal core 3 is configured by a ceramics core made of ferrite or the like or a metal-based core. The toroidal core 3 has a first end surface 31 and a second end surface 32 opposing each other in the axial direction. The first end surface 31 opposes the lid body 22. The second end surface 32 opposes the bottom surface of the box body 21.

The first coil conductor 41 is wound around the toroidal core 3 between the first electrode terminal 51 and the second electrode terminal 52. The first coil conductor 41 has a first end portion 411 and a second end portion 412. The first end portion 411 is connected to the first electrode terminal 51 with a bonding member 7 interposed therebetween. The second end portion 412 is connected to the second electrode terminal 52 with another bonding member 7 interposed therebetween. The bonding member 7 is a solder, for example.

The second coil conductor 42 is wound around the toroidal core 3 between the third electrode terminal 53 and the fourth electrode terminal 54. The second coil conductor 42 has a first end portion 421 and a second end portion 422. The first end portion 421 is connected to the third electrode terminal 53 with the bonding member 7 interposed therebetween. The second end portion 422 is connected to the fourth electrode terminal 54 with the bonding member 7 interposed therebetween.

The winding direction of the first coil conductor 41 around the toroidal core 3 and the winding direction of the second coil conductor 42 around the toroidal core 3 are reversed. The number of turns of the first coil conductor 41 and the number of turns of the second coil conductor 42 are the same.

The first coil conductor 41 is configured by a plurality of first pin members 41*a* and a plurality of second pin members 41*b*. The first pin members 41*a* are bent pins bent into a substantially U-shaped form. The second pin members 41*b* are straight pins extended in a substantially straight-line form.

The first and second pin members 41*a* and 41*b* are alternately bonded by a bonding material. One end of the second pin member 41*b* is connected to one end of one of a pair of adjacent first pin members 41*a* and 41*a* and the other end of the second pin member 41*b* is connected to one end of the other one of the first pin members 41*a* and 41*a*. The above-described connection of the first and second pin members 41*a* and 41*b* is repeated, so that the plurality of first and second pin members 41*a* and 41*b* are wound around the toroidal core 3 in a substantially spiral form. That is to say, one first pin member 41*a* and one second pin member 41*b* configure a unit element of substantially one turn.

The second coil conductor 42 is configured by a plurality of first pin members 42*a* and a plurality of second pin members 42*b* in the same manner as the first coil conductor 41. It should be noted that each of the first coil conductor 41 and the second coil conductor 42 is configured by the plurality of pin members but may be configured by a wire.

The ferrite beads 61 to 64 are configured by magnetic bodies made of NiZn, MnZn, or the like, for example. The ferrite beads 61 to 64 are formed to have substantially cylindrical shapes.

The first ferrite bead 61 is located at the first end portion 411 side of the first coil conductor 41. That is to say, the first ferrite bead 61 is located at a position to which the first coil conductor 41 is wound by substantially one turn from the first end portion 411. The second ferrite bead 62 is located at the second end portion 412 side of the first coil conductor 41. That is to say, the second ferrite bead 62 is located at a position to which the first coil conductor 41 is wound by substantially one turn from the second end portion 412.

The third ferrite bead 63 is located at the first end portion 421 side of the second coil conductor 42. That is to say, the third ferrite bead 63 is located at a position to which the second coil conductor 42 is wound by substantially one turn from the first end portion 421. The fourth ferrite bead 64 is located at the second end portion 422 side of the second coil conductor 42. That is to say, the fourth ferrite bead 64 is located at a position to which the second coil conductor 42 is wound by substantially one turn from the second end portion 422.

The first coil conductor 41 is not wound around each of the first and second ferrite beads 61 and 62 and one first coil conductor 41 is inserted thereinto. That is to say, a part of the first pin member 41a is inserted into each of the first and second ferrite beads 61 and 62. In other words, the first coil conductor 41 in the first ferrite bead 61 is one on a cross section of the first ferrite bead 61 in the direction orthogonal to the axis C thereof. The same holds true for the second ferrite bead 62.

In the same manner, the second coil conductor 42 is not wound around each of the third and fourth ferrite beads 63 and 64 and one second coil conductor 42 is inserted thereinto. That is to say, the second coil conductor 42 in the third ferrite bead 63 is one on a cross section of the third ferrite bead 63 in the direction orthogonal to the axis C thereof. The same holds true for the fourth ferrite bead 64.

The axis C of each of the first to fourth ferrite beads 61 to 64 is not concentric with but is eccentric from the axis A of the toroidal core 3. That is to say, the axis C of each of the first to fourth ferrite beads 61 to 64 is parallel with the axis A of the toroidal core 3.

The first to fourth ferrite beads 61 to 64 are located on outer side portions relative to the toroidal core 3 in the radial direction B. That is to say, the first to fourth ferrite beads 61 to 64 oppose the outer circumferential surface of the toroidal core 3.

The first to fourth ferrite beads 61 to 64 are located on corner portions of the case 2. That is to say, the first to fourth ferrite beads 61 to 64 are located on four corners of the case 2, respectively.

Figure 4:
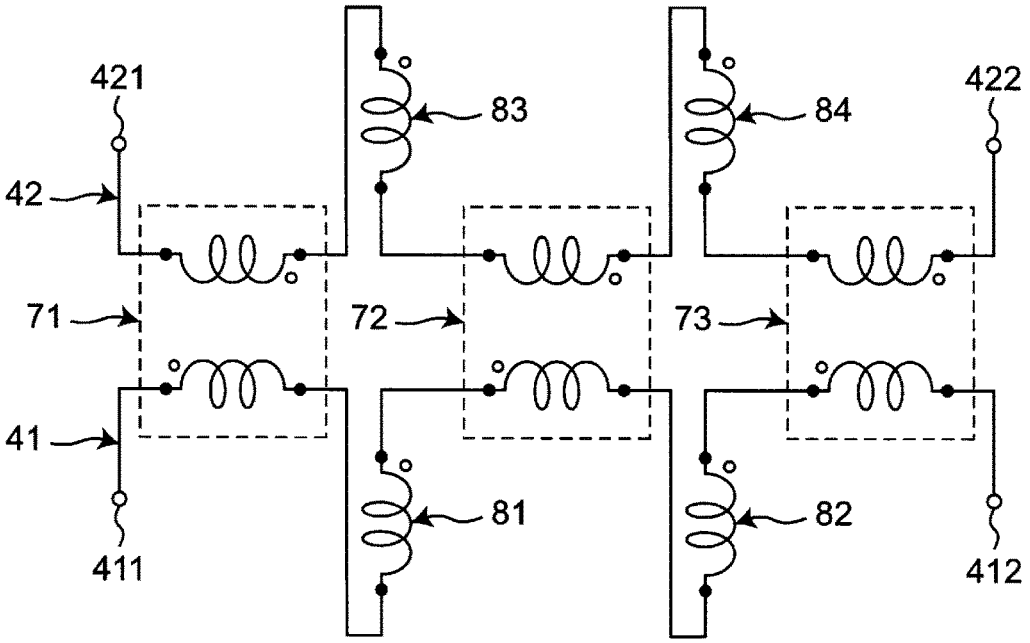
FIG. 4 is a circuit diagram illustrating an equivalent circuit of the coil component.

FIG. 4 is an equivalent circuit of the coil component 1. As illustrated in FIG. 2 and FIG. 4, the coil component 1 includes first to third common mode choke coils 71 to 73 and first to fourth normal mode choke coils 81 to 84.

The first common mode choke coil 71 is configured by a portion of the first coil conductor 41 between the first end portion 411 and the first ferrite bead 61, a portion of the second coil conductor 42 between the first end portion 421 and the third ferrite bead 63, and the toroidal core 3. The second common mode choke coil 72 is configured by a portion of the first coil conductor 41 between the first ferrite bead 61 and the second ferrite bead 62, a portion of the second coil conductor 42 between the third ferrite bead 63 and the fourth ferrite bead 64, and the toroidal core 3. The third common mode choke coil 73 is configured by a portion of the first coil conductor 41 between the second ferrite bead 62 and the second end portion 412, a portion of the second coil conductor 42 between the fourth ferrite bead 64 and the second end portion 422, and the toroidal core 3.

The first normal mode choke coil 81 is configured by the first ferrite bead 61 and the first coil conductor 41. The second normal mode choke coil 82 is configured by the second ferrite bead 62 and the first coil conductor 41. The third normal mode choke coil 83 is configured by the third ferrite bead 63 and the second coil conductor 42. The fourth normal mode choke coil 84 is configured by the fourth ferrite bead 64 and the second coil conductor 42.

Next, operations of the coil component 1 will be described. The coil component 1 removes noise of a normal mode component and noise of a common mode component.

Noise removal of the normal mode component is described. A normal mode current flows through the first coil conductor 41 in the direction toward the second end portion 412 from the first end portion 411, and flows through the second coil conductor 42 in the direction toward the first end portion 421 from the second end portion 422.

When the normal mode current flows through the first coil conductor 41, a first magnetic flux by the first coil conductor 41 is generated in the toroidal core 3. When the normal mode current flows through the second coil conductor 42, a second magnetic flux in the direction reverse to that of the first magnetic flux is generated in the toroidal core 3. The first magnetic flux and the second magnetic flux in the toroidal core 3 cancel each other. Therefore, the first coil conductor 41 and the toroidal core 3 and the second coil conductor 42 and the toroidal core 3 do not act as inductance components.

Meanwhile, when the normal mode current flows through the first coil conductor 41, a magnetic flux by the first coil conductor 41 is generated in each of the first and second ferrite beads 61 and 62. When the normal mode current flows through the second coil conductor 42, a magnetic flux by the second coil conductor 42 is generated in each of the third and fourth ferrite beads 63 and 64. Therefore, the first coil conductor 41 and the first and second ferrite beads 61 and 62 act as inductances and the second coil conductor 42 and the third and fourth ferrite beads 63 and 64 act as inductances. With this, the noise of the normal mode component is removed.

Noise removal of the common mode component is described. A common mode current flows through the first coil conductor 41 in the direction toward the second end portion 412 from the first end portion 411, and flows through the second coil conductor 42 in the direction toward the second end portion 422 from the first end portion 421.

When the common mode current flows through the first coil conductor 41, a first magnetic flux by the first coil conductor 41 is generated in the toroidal core 3. When the common mode current flows through the second coil conductor 42, a second magnetic flux in the direction the same as that of the first magnetic flux is generated in the toroidal core 3. Therefore, the first coil conductor 41 and the toroidal core 3 and the second coil conductor 42 and the toroidal core 3 act as inductance components. With this, the noise of the common mode component is removed.

Figure 5:
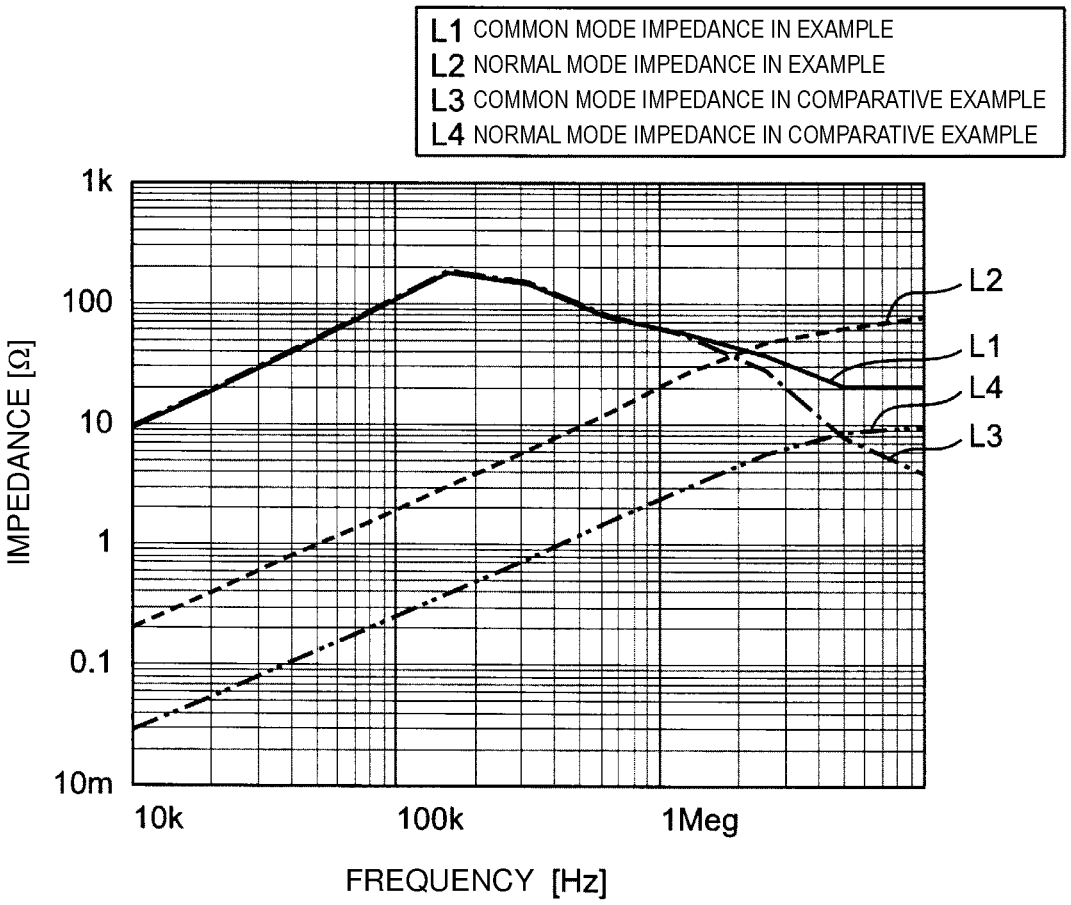
FIG. 5 is a graph illustrating a relation between frequency and impedance of the coil component.

FIG. 5 is a graph illustrating a relation between frequency and impedance of the coil component. A transverse axis indicates the frequency (Hz) and a longitudinal axis indicates the impedance (Ω). A solid line L1 indicates common mode impedance in the Example of the disclosure. A dashed line L2 indicates normal mode impedance in the Example of the disclosure. A dashed-dotted line L3 indicates common mode impedance in the Comparative Example. A dashed-two dotted line L4 indicates normal mode impedance in the Comparative Example.

In the Example of the disclosure, the structure of the coil component in FIG. 2 is employed. A material of the toroidal core is MnZn and a material of the ferrite bead is NiZn. The Comparative Example is different from the Example in a point that no ferrite bead is provided.

As is seen from FIG. 5, the common mode impedance (solid line L1) in the Example is substantially the same as the common mode impedance (dashed-dotted line L3) in the Comparative Example. The normal mode impedance (dashed line L2) in the Example is higher than the normal mode impedance (dashed-two dotted line L4) in the Comparative Example.

With the above-described coil component 1, the first and second ferrite beads 61 and 62 are attached to the first coil conductor 41 and the third and fourth ferrite beads 63 and 64 are attached to the second coil conductor 42. Accordingly, the normal mode impedance can be increased while maintaining the common mode impedance. Furthermore, the material of the ferrite beads 61 to 64 can be made different from the material of the toroidal core 3, thereby enhancing the degree of freedom of the normal mode impedance.

One first coil conductor 41 is inserted into each of the first and second ferrite beads 61 and 62 and one second coil conductor 42 is inserted into each of the third and fourth ferrite beads 63 and 64. Accordingly, the ferrite beads 61 to can be reduced in size and can be attached to desired positions.

Moreover, the first and second ferrite beads 61 and 62 are located at the sides of the end portions 411 and 412 of the first coil conductor 41, respectively, and the third and fourth ferrite beads 63 and 64 are located at the sides of the end portions 421 and 422 of the second coil conductor 42, respectively. Accordingly, the ferrite beads 61 to 64 are easy to be attached to the coil conductors 41 and 42.

Furthermore, the axes C of the ferrite beads 61 to 64 are not concentric with but are eccentric from the axis A of the toroidal core 3. Accordingly, the attachment positions of the ferrite beads 61 to 64 are not limited.

In addition, the ferrite beads 61 to 64 are located on the outer side portions relative to the toroidal core 3 in the radial direction. Accordingly, the degree of freedom of arrangement of the ferrite beads 61 to 64 relative to the toroidal core 3 is enhanced.

Moreover, the ferrite beads 61 to 64 are located on the corner portions of the case 2. Accordingly, the ferrite beads 61 to 64 can be arranged in dead spaces on the corner portions of the case 2, thereby utilizing the dead spaces effectively.

It should be noted that the disclosure is not limited to the above-described embodiment and can be changed in design in a range without departing from the scope of the disclosure.

Although the number of ferrite beads is four in the above-described embodiment, it may be at least one.

Although the plurality of ferrite beads are attached to the first coil conductor and the second coil conductor in the above-described embodiment, they may be attached to the first coil conductor or the second coil conductor.

Although the ferrite beads are located on the outer side portions relative to the toroidal core in the radial direction B in the above-described embodiment, they may be located at inner side portions relative to the toroidal core in the radial direction B. In this case, the dead space in the toroidal core can be utilized effectively.

Although the case has the substantially rectangular shape in the above-described embodiment, it may have a substantially circular shape.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a toroidal core;

a first coil conductor and a second coil conductor wound around the toroidal core; and a ferrite bead attached to at least one coil conductor of the first coil conductor and the second coil conductor, wherein the ferrite bead is located between and extends along coil turns of the at least one coil conductor.

2. The coil component according to claim 1, wherein one coil conductor is inserted into the ferrite bead.

3. The coil component according to claim 1, wherein an axis of the ferrite bead is eccentric from an axis of the toroidal core.

4. The coil component according to claim 1, wherein the ferrite bead is located at an end portion side of the coil conductor.

5. The coil component according to claim 1, wherein the ferrite bead is located on an outer side portion relative to the toroidal core in a radial direction with respect to the axis of the toroidal core.

6. The coil component according to claim 1, including a case accommodating the toroidal core, wherein a shape of the case is rectangular when seen from an axial direction of the toroidal core, and the ferrite bead is located on a corner portion of the case.

7. A coil component comprising:

a toroidal core;

a first coil conductor and a second coil conductor wound around the toroidal core;

a ferrite bead attached to at least one coil conductor of the first coil conductor and the second coil conductor; and a case accommodating the toroidal core, wherein a shape of an inner surface of the case has at least one corner when seen from an axial direction of the toroidal core, and the ferrite bead is located on the at least one corner inside the inner surface of the case.

* * * * *